US011098599B2

(12) United States Patent
Ramm

(10) Patent No.: US 11,098,599 B2
(45) Date of Patent: Aug. 24, 2021

(54) FLOW CHANNEL FOR A TURBOMACHINE

(71) Applicant: MTU Aero Engines AG, Munich (DE)

(72) Inventor: Guenter Ramm, Eichenau (DE)

(73) Assignee: MTU Aero Engines AG, Munich (DE)

( * ) Notice: Subject to any disclaimer, the term of this patent is extended or adjusted under 35 U.S.C. 154(b) by 148 days.

(21) Appl. No.: 16/205,403

(22) Filed: Nov. 30, 2018

(65) Prior Publication Data

US 2019/0178095 A1 Jun. 13, 2019

(30) Foreign Application Priority Data

Dec. 7, 2017 (DE) ..... 102017222193.3

(51) Int. Cl.

| | |
|---|---|
| ***F01D 9/02*** | (2006.01) |
| ***F01D 25/16*** | (2006.01) |
| ***F01D 9/06*** | (2006.01) |
| ***F01D 9/04*** | (2006.01) |

(52) U.S. Cl.

CPC ..... *F01D 9/023* (2013.01); *F01D 9/041* (2013.01); *F01D 9/065* (2013.01); *F01D 25/162* (2013.01); *F05D 2240/12* (2013.01); *F05D 2260/961* (2013.01)

(58) Field of Classification Search

CPC ..... F01D 9/023; F01D 9/041; F01D 9/065; F01D 25/162; F01D 25/24; F01D 25/28; F01D 25/18; F01D 25/12; F05D 2240/12; F05D 2260/961

See application file for complete search history.

(56) References Cited

U.S. PATENT DOCUMENTS

| | | | | |
|---|---|---|---|---|
| 2,928,648 | A | 3/1960 | Haines et al. | |
| 2,936,999 | A * | 5/1960 | Jacobus | F01D 9/065 415/134 |
| 2,941,781 | A | 6/1960 | Boyum | |
| 3,704,075 | A | 11/1972 | Karstensen et al. | |
| 7,258,525 | B2 | 8/2007 | Boeck | |
| 7,553,129 | B2 | 6/2009 | Hoeger et al. | |

(Continued)

FOREIGN PATENT DOCUMENTS

| | | | |
|---|---|---|---|
| DE | 102004036594 | A1 | 3/2006 |
| DE | 102011008812 | A1 | 7/2012 |

(Continued)

*Primary Examiner* — J. Todd Newton
*Assistant Examiner* — Eric J Zamora Alvarez
(74) *Attorney, Agent, or Firm* — Davidson, Davidson & Kappel, LLC

(57) ABSTRACT

A flow channel for a turbomachine, in particular a gas turbine, having a plurality of ribs that are disposed between a radially inner lateral surface and a radially outer lateral surface of the flow channel and are circumferentially distributed; a first rib of the ribs having a first rib thickness and a first rib length, and a second rib of the ribs having a second rib thickness and a second rib length, the second rib length being shorter than the first rib length, and/or the second rib thickness being smaller than the first rib thickness; a spacing in the circumferential direction between the first rib and the second rib adjacent thereto, and a spacing in the circumferential direction between at least two adjacent ribs of the ribs mutually deviating, and at least one of these ribs having a non-deflecting external profile and or an internal structure being disposed therein.

22 Claims, 1 Drawing Sheet

(56) References Cited

U.S. PATENT DOCUMENTS

| | | | |
|---|---|---|---|
| 9,382,806 | B2 | 7/2016 | Hoeger |
| 2010/0275572 | A1 | 11/2010 | Durocher et al. |
| 2013/0051996 | A1 | 2/2013 | Hoeger et al. |
| 2013/0330180 | A1 | 12/2013 | Guendogdu et al. |
| 2014/0182972 | A1 | 7/2014 | Hetherington et al. |
| 2016/0061054 | A1 | 3/2016 | Nolchef et al. |
| 2016/0258322 | A1* | 9/2016 | Winn ..... F01D 25/145 |

FOREIGN PATENT DOCUMENTS

| | | | |
|---|---|---|---|
| EP | 1483482 | B1 | 12/2004 |
| EP | 2669474 | A1 | 12/2013 |
| EP | 2746542 | A2 | 6/2014 |
| EP | 3095964 | A1 | 11/2016 |
| EP | 3121383 | A1 | 1/2017 |
| WO | WO2013165281 | A1 | 11/2013 |

* cited by examiner

FLOW CHANNEL FOR A TURBOMACHINE

The present invention relates to a flow channel, in particular a transition channel for a turbomachine, in particular a gas turbine, a turbomachine, in particular a gas turbine, having the flow channel, respectively transition channel, as well as an aircraft engine having the gas turbine.

BACKGROUND

The European Patent Application EP 2 669 474 A1 describes a transition channel having support ribs and flow divider vanes having a solid cross section and an external profile for deflecting a flow, which, circumferentially, have different spacings and different chord lengths.

The U.S. Pat. No. 3,704,075 describes a flow channel passage between two rotors within which are disposed circumferentially uniformly distributed deflector vanes and support ribs having conduits.

SUMMARY OF THE INVENTION

It is an object of an embodiment of the present invention to improve a turbomachine.

In an embodiment of the present invention, a flow channel for a turbomachine, in particular a flow channel of a turbomachine, in particular an axial turbomachine, in particular a gas turbine, in particular of an aircraft engine, has a plurality of ribs that are disposed between a radially inner lateral surface and a radially outer lateral surface of the flow channel; in an embodiment, removably or non-removably, in particular joined in a material-to-material bond to or integrally formed with the inner and/or outer lateral surface, and/or are distributed in a circumferential direction, in particular at least partially adjacently, respectively in the axial direction, to be at least partially overlapping; a first of the ribs having a first, in particular maximum, minimum or medium rib thickness, in particular (measured) circumferentially, and a first, in particular maximum, minimum or medium rib length, in particular chord length and/or (measured) axially; and a second of the ribs having a second, in particular maximum, minimum or medium rib thickness, in particular (measured) circumferentially, and a second, in particular maximum, minimum or medium rib length, in particular chord length and/or (measured) axially.

In an embodiment, the axial direction is parallel to an axis of rotation, in particular (main) machine axis of the turbomachine; correspondingly, the circumferential direction is, in particular, a rotational direction about this axis. In an embodiment, a radial direction is normal to the axial and circumferential direction.

In an embodiment of the present invention, this second rib length is shorter than this first rib length; in an embodiment, by at least 1%, in particular by at least 5%; in an embodiment, by at least 15%, and/or by at most 200%, in particular by at most 100%; in an embodiment, by at most 50%, of the first or second rib length. Additionally or alternatively, in an embodiment of the present invention, this second rib thickness is smaller than this first rib thickness; in an embodiment, by at least 1%, in particular by at least 5%, in an embodiment, by at least 15%, and/or by at most 200%, in particular by at most 100%, in an embodiment, by at most 50% of the first or second rib thickness.

In an embodiment of the present invention, within the first rib, a first internal structure is disposed, which has a first, in particular maximum, minimum or medium structural thickness, in particular (measured) in the circumferential or axial direction; and, within the second rib, a second internal structure is disposed, which has a second, in particular maximum, minimum or medium structural thickness, in particular (measured) in the circumferential or axial direction, that is smaller than the first structural thickness, in an embodiment, by at least 1%, in particular by at least 5%, in an embodiment, by at least 15%, and/or by at most 200%, in particular by at most 100%; in an embodiment, by at most 50%, of the first or second structural thickness.

In other words, in an embodiment of the present invention, (at least) a (first) rib, within which a thicker internal structure is disposed, is (dimensioned) to be thicker and/or longer than (at least) a (second) rib within which a comparatively thinner internal structure is disposed.

In an embodiment, this makes it possible to improve a weight and/or efficiency.

In an embodiment, for one or a plurality of pairs A, B of the plurality of ribs, (in each case) a deviation $|(d_A/l_A)-(d_B/l_B)|$ between a ratio $d_A/l_A$ of an, in particular maximum, minimum or medium rib thickness $d_A$, in particular (measured) circumferentially, divided by an, in particular maximum, minimum or medium rib length $l_A$, in particular chord length, and/or (measured) in the axial direction of the one rib A of these two ribs (of the respective pair) and a ratio $d_B/l_B$ of an, in particular maximum, minimum or medium rib thickness $d_B$, in particular (measured) circumferentially, divided by an, in particular maximum, minimum or medium rib length $l_B$, in particular chord length and/or (measured) in the axial direction of other rib B of these two ribs (of the respective pair, in each case), is at most 15%, in particular at most 10%, in an embodiment, at most 5%, in particular at most 1% of the smaller or larger of these two ratios; within this one rib A (in each case) an internal structure being disposed having an, in particular maximum, minimum or medium structural thickness, in particular (measured) in the circumferential or axial direction, which, in particular is smaller by at least 1% and/or by at most 200% than an, in particular maximum, minimum or medium structural thickness, in particular (measured) in the circumferential or axial direction, of an internal structure that is disposed within this other rib B; in an embodiment, rib length $l_A$ of this one rib A, being shorter, in particular by at least 1%, in particular by at least 5%; in an embodiment by at least 15%, and/or by at most 200%, in particular by at most 100%, in an embodiment, by at most 50% of the larger or smaller of the two rib lengths $l_A$, $l_B$ than rib length $l_B$ of this other rib B of the two ribs (of the respective pair); and/or rib thickness $d_A$ of this one rib A being smaller, in particular by at least 1%, in particular by at least 5%, in an embodiment by at least 15%, and/or by at most 200%, in particular by at most 100%, in an embodiment, by at most 50% of the larger or smaller of the two rib thicknesses $d_A$, $d_B$ than rib thickness $d_B$ of this other rib B of the two ribs (of the respective pair).

The one and other rib of a pair may, in particular be the above mentioned first and second rib. In an embodiment, the one and other rib of one or of a plurality of pairs may be adjacent (in each case circumferentially). Similarly, in an embodiment, one or a plurality of further ribs without any internal structure and/or having at least essentially the same rib thickness and length as the one or other rib may be disposed between the one and other rib of one or of a plurality of pairs (in each case, circumferentially).

In other words, an embodiment of the present invention specifies at least essentially the same rib thickness/length ratio d/l for two or more of the ribs having internal structures of different thicknesses.

In an embodiment, this makes it possible to (further) improve a weight and/or efficiency.

Additionally or alternatively to the above aspect of different rib thicknesses and/or lengths, in particular at essentially the same rib thickness/length ratio d/l, for internal structures of different thicknesses, in an embodiment of the present invention, a spacing $T_{12}$ in the circumferential direction between the first and the second rib (circumferentially) adjacent thereto and a spacing $T_{23}$ in the circumferential direction between at least two of the (circumferentially) adjacent ribs, differ or deviate (from one another); in particular spacing $T_{12}$ between the first and second rib and spacing between the first and third rib that is disposed on the side of the first rib opposite the second rib; spacing $T_{12}$ between the first and second rib, and spacing $T_{23}$ between the second and third rib that is disposed on the side of the second rib opposite the first rib, and/or spacing $T_{12}$ between the first and the second rib, and spacing between a third rib and fourth rib (circumferentially) adjacent thereto that differ from the first and second rib; in an embodiment, at least one of these ribs, in particular the first, second, third and/or fourth rib, having a non-deflecting external profile (in each case); and, additionally or alternatively, within at least one of these ribs, in particular the first, second, third and/or fourth rib, an internal structure being disposed (in each case), in particular the first internal structure within the first rib and/or the second internal structure within the second rib.

In an embodiment, these two spacings differ or deviate (from one another) by at least 1%, in particular by at least 5%; in an embodiment by at least 15%, and/or by at most 200%, in particular by at most 100%; in an embodiment by at most 50% of the larger or smaller of the two spacings.

In other words, this aspect provides for unevenly circumferentially distributing ribs having at least somewhat different rib lengths and/or thicknesses, of which one or a plurality each have internal structures and/or non-deflecting external profiles.

In an embodiment, a frequency response or resonance response of the flow channel may be hereby improved.

As already mentioned, these two aspects of different rib thicknesses and/or lengths, in particular, at least essentially the same rib thickness/length ratio d/l, may be realized, on the one hand, for internal structures of different thicknesses, and, on the other hand, independently of each other, for an uneven circumferential distribution of ribs having at least somewhat different rib lengths and/or thicknesses, which at least partially have internal structures and/or non-deflecting external profiles; however, in an embodiment, it being possible for them to be advantageously combined with one another. In other words, in an embodiment or combination of both aspects, the plurality of ribs have two or more internal structures of different thicknesses, as well as different rib thicknesses and/or lengths, in particular at least essentially the same rib thickness/length ratio; in addition, this and/or other ribs of the plurality of ribs being unevenly circumferentially distributed.

In an embodiment, this makes it possible to (further) improve a frequency response or resonance response and/or efficiency of the flow channel.

On the basis of the particular circumferential positions and/or the particular dimensions of each of the plurality of ribs, in an embodiment, the symmetry of the flow channel in an area between the inner and outer lateral surface has an order of n, n being ≤8, n≤7, n≤6, n≤5, n≤4, n≤3, n≤2, n≤8, n≤4, n≤2 and/or n being =1. Thus, for this, only the circumferential positions and/or dimensions of the plurality of ribs are considered, not, however, a symmetry of possibly contoured radially inner and outer gas channel walls. An order of symmetry of n signifies that a rotated rib array first again coincides with the unrotated rib array, respectively circumferential positions of the ribs or with respect to circumferential positions and dimensions of the ribs at a rotation of 360°/n about the rotation machine axis, in particular (main) machine axis of the turbomachine. This means that, at a 360° rotation, exactly n congruent rib arrays result with respect to rib spacing and/or rib formation. This may render possible an especially efficient, material-saving array where the overall configuration of the ribs relative to the individual circumferential positions, the individual rib spacings and/or the particular dimensions of the individual ribs, in particular also in consideration of aerodynamic aspects, is specially adapted to the periphery.

In an embodiment, the first rib and/or the second rib, in particular the first rib, within which the first internal structure is disposed, and/or the second rib, within which the second internal structure is disposed, whose structural thickness is smaller than the first structural thickness, (each) feature a non-deflecting external profile, in particular in addition to or also without mutually deviating spacing(s) in the circumferential direction, respectively in the case of an uneven circumferential distribution of the plurality of ribs.

In an embodiment, a non-deflecting external profile is shaped to at least essentially not change a flow of a working fluid, in particular of a working gas, within the, respectively through the flow channel, in particular in such a way that a direction of a flow exiting from a downstream trailing edge of the external profile deviates by at most 5°, in particular by at most 1° from a direction of an, in particular purely axial, incident flow directed towards an upstream leading edge of the external profile and/or from the axial direction. In an embodiment, a pitch angle of the external profile and/or an angle between a chord line of the external profile and the axial direction (in each case) is at most 5°, in particular at most 1°. Additionally or alternatively, in an embodiment, a profile curvature, respectively maximum deviation of a camber line from a chord line of the external profile is at most 0.01, in particular at most 0.005. In an embodiment, a non-deflecting external profile is at least essentially mirror-symmetric along the axial longitudinal axis thereof.

In an embodiment, this makes it possible to (further) improve a frequency response or resonance response and/or efficiency of the flow channel.

One or a plurality of the internal structure(s), thus, in particular, the first and/or second internal structure(s) and/or the internal structure that is disposed within the one or other rib of at least one of the pairs having mutually deviating spacings circumferentially, and/or at least essentially the same rib thickness/rib length ratio, (in each case) may have, in particular be one or a plurality of strut(s) and/or one or a plurality of through passage(s) that are provided, adapted or used for conveying gas and/or fluid. In an embodiment, a through passage for conveying gas and/or fluid has an interface, in particular a connection for introducing or removing gas and/or fluid.

In an embodiment, various internal structures may have, in particular be different types of through passages; in particular, at least one of the internal structures may have a strut, and at least one other of the internal structures, a through passage for conveying a gas and/or a fluid, at least one of the internal structures, a through passage for conveying a gas and at least one other of the internal structures a through passage for conveying a fluid, and/or at least one of the internal structures, a through passage for conveying a gas or a fluid, and at least one other of the internal structures, a through passage for conveying a different gas or a different fluid.

In an embodiment, struts may advantageously brace the radially inner and outer lateral surfaces of the flow channel against each other; lubricants, in particular oil, coolants, in particular air, and/or other operating materials, may be advantageously conveyed through through passages, especially over short paths.

One or a plurality of the internal structure(s), thus, in particular, the first and/or second internal structure(s) and/or the internal structure that is disposed within the one or other rib of at least one of the pairs having mutually deviating spacings circumferentially, and/or at least essentially the same rib thickness/rib length ratio, may be manufactured completely or partially integrally (in each case) with the (respective) rib within which it is disposed. This holds, in particular for (integrally manufactured or formed) through passages.

Similarly, one or a plurality of the internal structures, thus, in particular the first and/or second internal structure(s) and/or the internal structure that is disposed within the one or other rib of at least one of the pairs having mutually deviating spacings circumferentially, and/or at least essentially the same rib thickness/rib length ratio, may be manufactured completely or partially separately from the (respective) rib within which it is/they are disposed. This holds, in particular for (separately manufactured or formed) struts. Similarly, through passages may also be additionally or alternatively manufactured or formed separately, in particular have or be ducts, conduits or the like.

In an embodiment, one or a plurality of groups of ribs of identical design (in each case, among themselves) of the plurality of ribs configured between the inner and outer lateral surfaces is/are circumferentially uniformly distributed (in each case, among themselves); and/or one or a plurality of groups of (other) ribs of identical design (among themselves) of the plurality of ribs is/are circumferentially unevenly distributed (among themselves). In an embodiment, a pitch between ribs of a group of uniformly distributed ribs varies by at most 2%, in particular by at most 1%. Additionally or alternatively, in an embodiment, a pitch between ribs of a group of unevenly distributed ribs varies by at least 5%, in particular by at least 10%; as is customary in the art, a pitch being, in particular a minimum, maximum or medium spacing in the circumferential direction between successive, identically designed ribs of the respective group.

In an embodiment, at least one strut is disposed, in each case, within the ribs of at least one group of uniformly distributed ribs, and/or at least one through passage for conveying gas and/or fluid is disposed, in each case, within the ribs of at least one group of unevenly distributed ribs.

In an embodiment, because of the uneven distribution, this makes it possible to advantageously (further) improve a frequency response or resonance response and/or efficiency of the flow channel and, at the same time, because of the uniform distribution, to (further) improve a weight distribution and/or force distribution.

In an embodiment, the flow channel is what is generally referred to as a transition channel, which, in a further embodiment, connects an upstream flow cross section of the turbomachine to a downstream flow cross section thereof that is radially offset (therefrom), respectively is provided, adapted or used for this purpose. In an embodiment, the flow channel, respectively transition channel connects two compressors, in particular a high pressure and intermediate pressure or low pressure compressor, or an intermediate pressure and a low pressure compressor, or two turbines, in particular a high pressure and an intermediate pressure or low pressure turbine, or an intermediate pressure and a low pressure turbine of the turbomachine, respectively is provided, adapted or used for this purpose.

In an embodiment, the turbomachine is an axial (flow) turbomachine, in particular a gas turbine, in particular of an aircraft engine.

This represents especially advantageous uses of a flow channel according to the present invention.

BRIEF DESCRIPTION OF THE DRAWINGS

Other advantageous embodiments of the present invention will become apparent from the dependent claims and the following description of preferred embodiments. To this end, the drawing shows, partly in schematic form, in:

DETAILED DESCRIPTION

Figure 2:
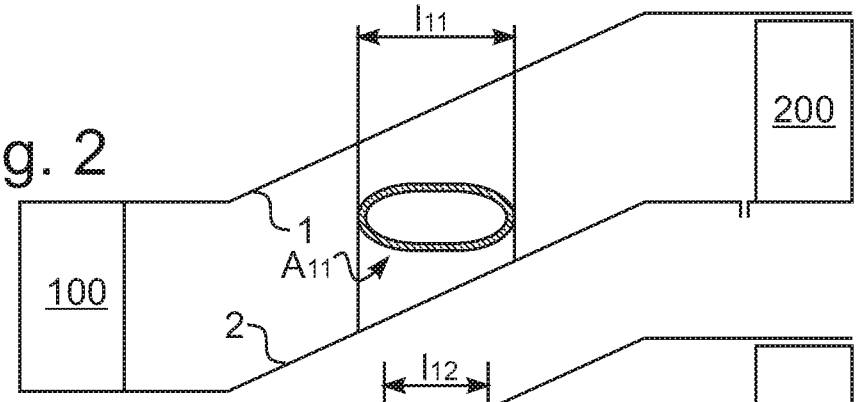
FIG. 2 a median section along line II-II in FIG. 1.
Figure 3:
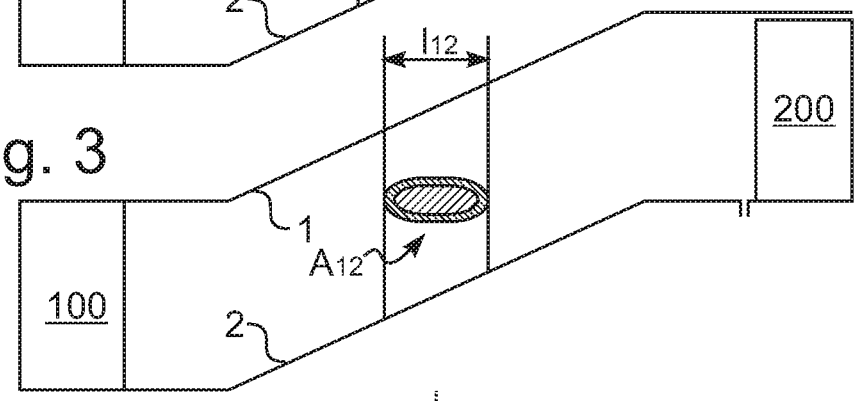
FIG. 3: another median section along line III-III in FIG. 1.
Figure 1:
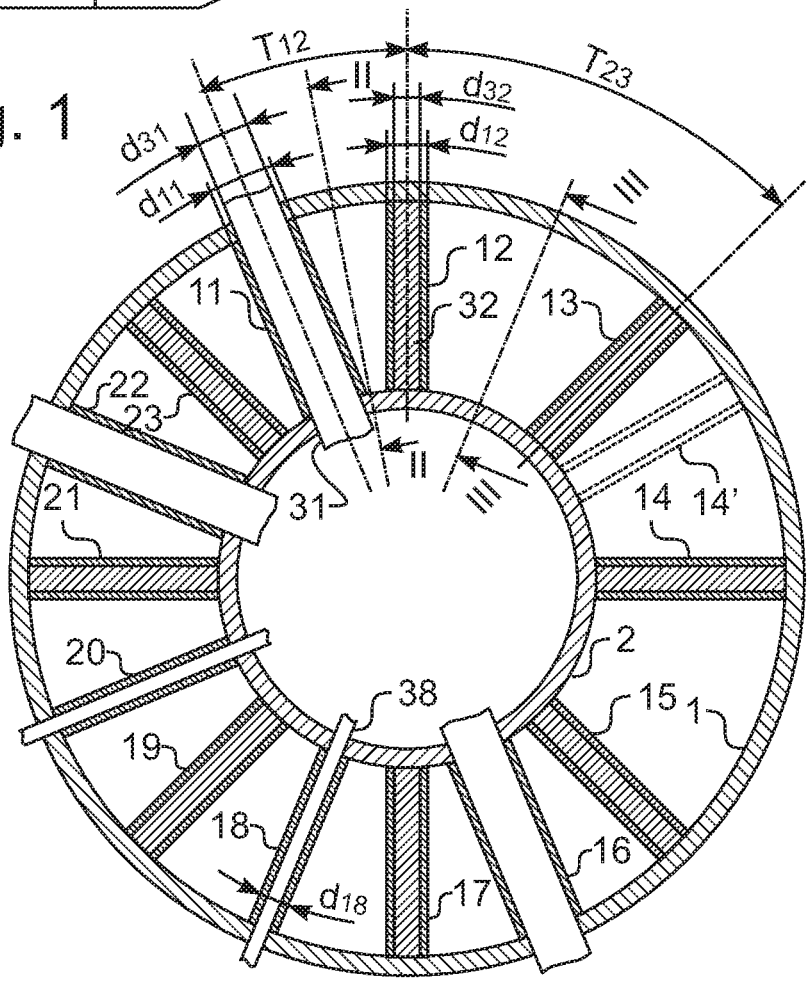
FIG. 1 a cross section of a transition channel in accordance with an embodiment of the present invention.

FIG. 1 shows a cross section of a transition channel in accordance with an embodiment of the present invention having a radially outer lateral surface 1 and a radially inner lateral surface 2, as well as a plurality of ribs 11-23 having a first rib 11, a second rib 12, a third rib 13, a fourth rib 14, etc. Rotated into median sections of FIG. 2, 3 in each case is a cross section of the illustrated rib, so that external profile $A_{11}$ of first rib 11 is discernible in FIG. 2, and external profile $A_{12}$ of second rib 12 is discernible in FIG. 3.

First rib 11 has a first rib thickness $d_{11}$ and a first rib length $l_{11}$ (compare FIG. 2); second rib 12 has a second rib thickness $d_{12}$ that is smaller than first rib thickness $d_{11}$, and a second rib length $l_{12}$ that is smaller than first rib length $l_{11}$.

Disposed within first rib 11 is a first internal structure in the form of an air supply 31, which has a first structural thickness $d_{31}$, and disposed within second rib 12 is a second internal structure in the form of a strut 32, which has a second structural thickness $d_{32}$ that is smaller than first structural thickness $d_{31}$.

Eighth rib 18 has a rib thickness $d_{18}$ that is even smaller than second rib thickness $d_{12}$, and a rib length $l_{18}$ (not shown) that is even smaller than second rib length $l_{12}$. Disposed within eighth rib 18 is another internal structure in the form of an oil supply 38, which has a structural thickness that is even smaller than second structural thickness $d_{32}$.

First rib 11, sixth rib 16 and 22nd rib 22 have an at least substantially mutually identical design. Eighth and tenth rib 18, 20 likewise have an at least substantially mutually identical design. Remaining ribs 12-15, 17, 19, 21 and 23, thus, in particular, second rib 12 and fourth rib 14, likewise have an at least substantially mutually identical design.

Thus, in each case, an internal structure in the form of an air supply (compare 31), strut (compare 32) or oil supply (compare 38) are configured in all of ribs 11-23. Also, all of ribs 11-23 have a non-deflecting external profile in each case.

Rib thickness/rib length ratio of ribs 11-23 is at least substantially constant. In particular, rib thickness/rib length ratios $d_{11}/l_{11}$, $d_{12}/l_{12}$ and $d_{18}/l_{18}$ are at least substantially equal.

With respect to the circumferential positions of the ribs and the circumferential positions and dimensions of the ribs, the rib array shown in FIG. 1 has an order of symmetry of n=1, i.e., the rib array is first again congruent at a 360° rotation.

Circumferentially, ribs 11-23 are unevenly distributed. In particular, spacing $T_{12}$ between first rib 11 and second rib 12 adjacent thereto, as well as the spacings equal thereto between adjacent ribs (15, 16), (16, 17), (17, 18), (18, 19), (19, 20), (20, 21), (22, 23) and (23, 11), respectively, deviate from spacing $T_{23}$ between second rib 11 and third rib 13 adjacent thereto, as well as the spacings equal thereto between adjacent ribs (13, 14) and (14, 15), respectively. This is because mutually identically designed ribs 12, 13, 14, 15, 17, 19, 21 and 23 having struts (compare 32) are uniformly distributed among themselves; and the likewise mutually identically designed ribs 11, 16 and 22, as well as likewise mutually identically designed ribs 18 and 20 are each only provided where there is an air or oil supply, and thus are unevenly circumferentially distributed; respectively, the need is eliminated for such thicker, longer or thinner, shorter ribs at corresponding locations of the circumferential pitch. In a modification, ribs 12-15, 17, 19, 21 and 23 may be unevenly distributed among themselves, as exemplarily indicated by a dashed-line rib 14'.

100, 200 indicate two flow cross sections, respectively compressors or turbines that are connected by the transition channel.

Although exemplary embodiments were explained in the preceding description, it should be noted that many modifications are possible. It should also be appreciated that the exemplary embodiments are merely examples and are in no way intended to restrict the scope of protection, the uses or the design. Rather, the foregoing description provides one skilled in the art with a guideline for realizing at least one exemplary embodiment; various modifications being possible, particularly with regard to the function and placement of the described components, without departing from the scope of protection as is derived from the claims and the combinations of features equivalent thereto.

REFERENCE NUMERAL LIST

1 radially outer lateral surface
2 radially inner lateral surface
11 first rib
12 second rib
13-23 third-thirteenth rib
31 air supply (first internal structure)
32 strut (second internal structure)
38 oil supply (internal structure)
100,
200 flow cross section/compressor/turbine
$A_{11}$,
$A_{12}$ external profile
$d_{11}$ first rib thickness
$d_{12}$ second rib thickness
$d_{18}$ rib thickness
$d_{31}$ first structural thickness
$d_{32}$ second structural thickness
$l_{11}$ first rib length
$l_{12}$ second rib length
$T_{12}$ spacing
$T_{23}$ spacing

The invention claimed is:

1. A flow channel for a turbomachine, the flow channel comprising:

a plurality of ribs disposed between a radially inner lateral surface and a radially outer lateral surface of the flow channel, the plurality of ribs being circumferentially distributed in a circumferential direction and including a first rib having a first rib thickness in the circumferential direction and a first rib length in an axial direction and a second rib having a second rib thickness in the circumferential direction and a second rib length in the axial direction, the second rib length being shorter than the first rib length, or the second rib thickness being smaller than the first rib thickness;

a spacing in the circumferential direction between the first rib and the second rib adjacent thereto and a further spacing in the circumferential direction at a same radial location between the first rib or the second rib and a further rib of the plurality of ribs adjacent to the first rib or second rib being different from the spacing, and at least one of the first, second and further ribs configured for contacting a working fluid in the flow channel and having a mirror-symmetric external profile.

2. The flow channel as recited in claim 1 wherein, for at least one pair of the plurality of ribs, a deviation between a ratio of a rib thickness divided by a rib length of one of the pair of ribs and a ratio of a rib thickness divided by a rib length of the other rib of the pair of ribs is at most 15%.

3. The flow channel as recited in claim 2 wherein within one of the pair of ribs, a first internal structure is disposed that has a structural thickness at least 1% or at most 200% smaller than a structural thickness of a second internal structure disposed within the other rib of the pair of ribs; and a rib length of one of the pair of ribs being at least 1% or at most 200% shorter than a rib length of the other rib of the pair of ribs, or a rib thickness of one of the pair of ribs being at least 1% or at most 200% smaller than a rib thickness of the other rib of the pair of ribs.

4. The flow channel as recited in claim 1 wherein the spacing and the further spacing deviate by at least 1% or by at most 200%.

5. The flow channel as recited in claim 1 wherein, with respect to particular circumferential positions or particular dimensions of each of the plurality of ribs, a symmetry of the flow channel in an area between the inner and outer lateral surface has an order of n; n being ≤8.

6. The flow channel as recited in claim 5 wherein n≤7.

7. The flow channel as recited in claim 5 wherein n≤6.

8. The flow channel as recited in claim 5 wherein n≤5.

9. The flow channel as recited in claim 5 wherein n≤4.

10. The flow channel as recited in claim 5 wherein n≤2.

11. The flow channel as recited in claim 5 wherein n=1.

12. The flow channel as recited in claim 1 wherein at least one of the first, second and further ribs has an internal structure.

13. The flow channel as recited in claim 12 wherein at least one of the first and second internal structures has at least one strut or a through passage for conveying gas or fluid, and is manufactured at least partially integrally with the first or second rib within which the at least one of the first and second internal structures is disposed, or separately therefrom.

14. The flow channel as recited in claim 12 wherein a first internal structure having a first structural thickness is disposed within the first rib; and a second internal structure having a second structural thickness smaller than the first structural thickness is disposed within the second rib.

15. The flow channel as recited in claim 1 wherein the plurality of ribs includes at least one further group of identically designed ribs that are circumferentially and uniformly distributed.

16. A transition channel comprising the flow channel as recited in claim 1 connecting an upstream flow cross section to a radially offset downstream flow cross section.

17. A turbomachine comprising at least one flow channel as recited in claim 1.

18. A gas turbine comprising the turbomachine as recited in claim 17.

19. An aircraft engine comprising the gas turbine as recited in claim 18.

20. The flow channel as recited in claim 1 wherein the first rib length is greater than the first rib thickness and the second rib length is greater than second rib thickness.

21. The flow channel as recited in claim 1 wherein a length of the mirror symmetric external profile in the axial direction is larger than the thickness in the circumferential direction.

22. A method for using the flow channel as recited in claim 1 comprising flowing the working fluid over the external profile.

* * * * *